United States Patent [19]

Ferrero

[11] 4,424,774

[45] Jan. 10, 1984

[54] SELF ADJUSTING HYDRAULIC TAPPET FOR HEAT ENGINES

[75] Inventor: Daniele Ferrero, Vinovo, Italy

[73] Assignee: RIV-SKF Officine di Villar Perosa, SpA, Turin, Italy

[21] Appl. No.: 303,053

[22] Filed: Sep. 17, 1981

[30] Foreign Application Priority Data

Nov. 21, 1980 [IT] Italy ..... 68785 A/80

[51] Int. Cl.[3] ..... F01L 1/24

[52] U.S. Cl. ..... 123/90.56

[58] Field of Search ..... 123/90.55, 90.56, 90.57

[56] References Cited

U.S. PATENT DOCUMENTS

| | | | |
|---|---|---|---|
| 3,877,446 | 4/1975 | Morgan | 123/90.55 |
| 4,279,226 | 7/1981 | Lampredi et al. | 123/90.55 |

FOREIGN PATENT DOCUMENTS

| | | | |
|---|---|---|---|
| 2758957 | 7/1979 | Fed. Rep. of Germany | 123/90.55 |
| 2829423 | 1/1980 | Fed. Rep. of Germany | 123/90.56 |
| 903983 | 8/1962 | United Kingdom | 123/90.55 |
| 1241634 | 8/1971 | United Kingdom | 123/90.56 |

*Primary Examiner*—Craig R. Feinberg
*Assistant Examiner*—W. R. Wolfe
*Attorney, Agent, or Firm*—Shlesinger, Arkwright, Garvey & Fado

[57] ABSTRACT

The tappet of the invention includes two movable elements defining between them a chamber which can be filled with oil arriving through at least one suitable duct from a source of oil under pressure; along this duct there is disposed an interception member comprising a ball able to cooperate with a corresponding seat into which the said duct opens.

7 Claims, 10 Drawing Figures

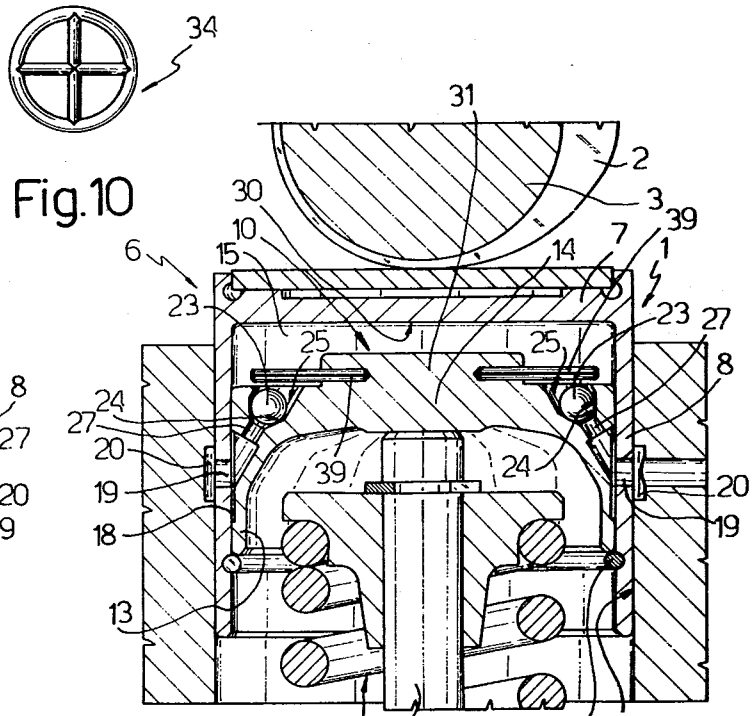
Fig.10
Fig.6
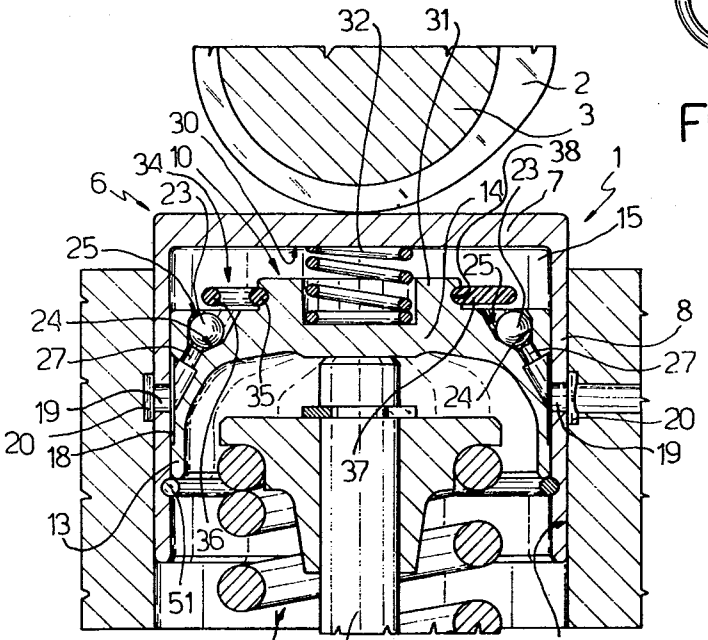
Fig.5

1
2
3
6
46
34
44
58
59
49
52
43
47
38
10
48
56
50a
53
9
51
50
54
54a
20
55
45
4

1
2
3
43
46
49
58
59
44
34
38
6
52
50a
47
10
48
57
53
9
51
50
54
54a
20
55
45
4

34
35
36
37

SELF ADJUSTING HYDRAULIC TAPPET FOR HEAT ENGINES

BACKGROUND OF THE INVENTION

The present invention relates to a self adjusting hydraulic tappet, particularly suitable for heat engines in which the control of the valves takes place by means of direct control from the cams without the interposition of rockers; such a tappet is particularly suitable for motors the speed of rotation of which is very high.

As is known, the members which control the opening and closing of the valves in combustion engines, that is to say the cam and the tappet, are subjected to wear in that they slide under pressure on one another, and in particular an element of the tappet, the cap, which is conveniently made of a material which wears more readily than that of the cam, becomes worn during operation thus causing a play which prevents the complete opening of the valve. Therefore, it is necessary periodically to effect adjustment with shims and, possibly, replace the cap. Moreover, the conditions of clearance between the cam and the valve vary in the various operating conditions of the engine, such clearance depending on the thermal expansion of the members of the kinematic chain interposed between the cam and the valve. There exist, however, mechanisms which adjust the clearance in a continuous and automatic manner as soon as it occurs: these are situated on the tappet and are substantially of hydraulic type.

A known hydraulic tappet comprises a first cup-shape body axially movable in a corresponding seat formed in the cylinder head of the engine and provided with a bottom wall which can be brought into contact with a cam of a cam shaft, and by a side wall, a second cup-shape body axially movable within the first and provided with a side wall and with an end wall which is able to define a chamber with the said walls of the first cup-shape body; in this chamber there is located a spring which can displace the second cup-shape body axially outwardly with respect to the first, and the end wall of the second cup-shape body is held in contact with the stem of a valve. The chamber thus defined is in communication, by means of ducts formed in the said cup-shape bodies, with a source of oil under pressure, and along the said ducts there are positioned interception members.

Such interception members are constituted by a resiliently deformable flat plate of substantially annular form located within the said chamber: the inner peripheral circular edge region of the said plate is fixed to the end wall of the second cup-shape body, whilst its outer peripheral part is operable to close the end of the first mentioned duct, which opens into the said chamber. The fixing of the plate to the end wall of the second cup-shape body is normally achieved by means of the said spring located between the end walls of the two cup-shape bodies; for this purpose this spring is formed as a cup spring and has an inner peripheral edge which can abut on the said inner peripheral edge region, and an outer peripheral edge which can abut on the end wall of the said first cup-shape body.

The described tappet has several disadvantages. Above all, the oil seal of the said interception members is rather critical and therefore these allow a certain quantity of oil to escape from the said chamber with the consequence that these chambers tend to become empty in a short time after the engine has stopped, and to achieve a complete filling of these (a condition to which corresponds complete elimination of clearances) rather extended times are necessary. The seal obtained with such interception members is acceptable, then, only if the oil pressure in the chamber itself is rather high and corresponding to that which is achieved only during average running conditions of the engine.

Moreover the structure of the tappet is complex and therefore it is expensive and not very reliable. In fact, above all, the assembly constituted by the thin plate of the valve means and by the cup spring which holds this latter in the correct working position, includes two resilient members which must have very rigorous forms and dimensions, and which must be positioned in a very precise manner between two cup-shape bodies. In addition the seat against which this thin plate rests, which is formed on the end wall of the second cup-shape body, and the thin plate itself, must have a very high surface finish and strict tolerances on the form and dimensions in order to be able to cooperate in a correct manner with one another, and therefore these must be subjected to a lapping operation. Finally, the said thin plate, being cyclically deformed, is subjected to fatigue stresses which could bring about breakage of the thin plate itself.

SUMMARY OF THE INVENTION

The object of the present invention is that of providing an hydraulic tappet of the type described with a very simple structure and of secure operation which will therefore be free from the above mentioned disadvantages. According to the present invention there is provided a self adjusting hydraulic tappet comprising a first element axially movable in a corresponding seat formed in the cylinder head of the engine and provided with at least one end wall which can be brought into contact with a cam of a cam shaft, and with a side wall, a second element axially movable within a cavity in the first in such a way as to define with it a chamber, and able to come into contact with the stem of a valve, the said chamber being in communication, by means of at least one duct formed in the said elements, with a source of fluid under pressure, and along the said duct there being located interception members, characterised by the fact that the said interception members include at least one ball which can cooperate with a corresponding seat formed along the said duct for closing the duct itself, the said seat being formed in the said second element in the region thereof in which the said duct opens into the said chamber.

BRIEF DESCRIPTION OF THE DRAWINGS

For a better understanding of the tappet of the present invention several embodiments of it will now be described with reference to the attached drawings, in which:

FIGS. 5 and 6 show another two variants of the tappet of the preceding Figures;

FIGS. 9 and 10 show stop members with which the tappet of the present invention is provided.

DETAILED DESCRIPTION OF THE INVENTION

Figure 4:
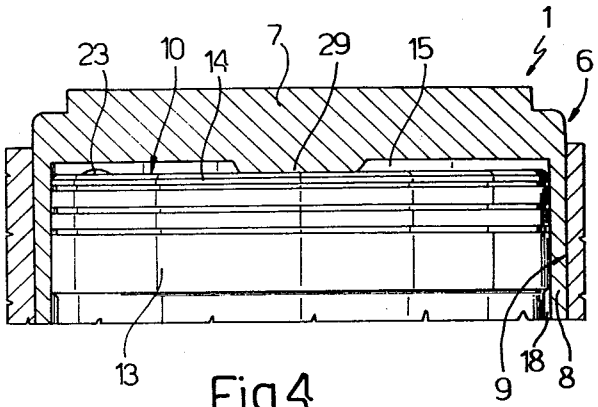
FIGS. 3 and 4 show, in detail, two variants of the tappet of the preceding Figures.

The tappet of the invention, indicated with the reference numeral 1, is interposed between a cam 2 of a cam shaft 3 and the stem 4 of a valve normally held, by the action of a spring assembly 5, against the tappet itself. Such valve control is of the "direct" type, that is to say it does not have an interposed rocker, and is of a type for which the tappet of the invention is particularly suitable. The tappet substantially comprises a first movable element 6 which has the form of a cup-shape body, provided with a substantially flat end wall 7 and with a side wall 8 which is slidable in a corresponding seat 9 formed in the engine block. Conveniently, the end wall 7 can include a cap (not illustrated) which can come into contact with the cam 2. The tappet further includes a second movable element which, in the case of the embodiment of FIGS. 1 to 6, also has the form of a cup-shape body 10, slidable within the preceding one, and also provided with a side wall 13 and with an end wall 14 which is able to come into contact with the stem 4 of the valve and to define, with the walls 7 and 8 of the first cup-shape body, a substantially cylindrical chamber 15.

This is in communication with a source of liquid under pressure, normally constituted by the flow of the engine's lubricating oil, through a channel comprising a first duct 16 formed in the end wall 14 of the second cup-shape body 10 and the axis of which is disposed radially with respect to the wall itself, a second duct 17 formed in the side wall 13 of the same body, which opens into an annular cavity 18 also formed in this wall; holes 19, formed in the side wall 8 of the first cup-shape body 6 put this cavity into communication with another annular cavity 20 formed in the engine block round the outer surface of the wall 8 and connected with the said source of liquid.

Figure 1:
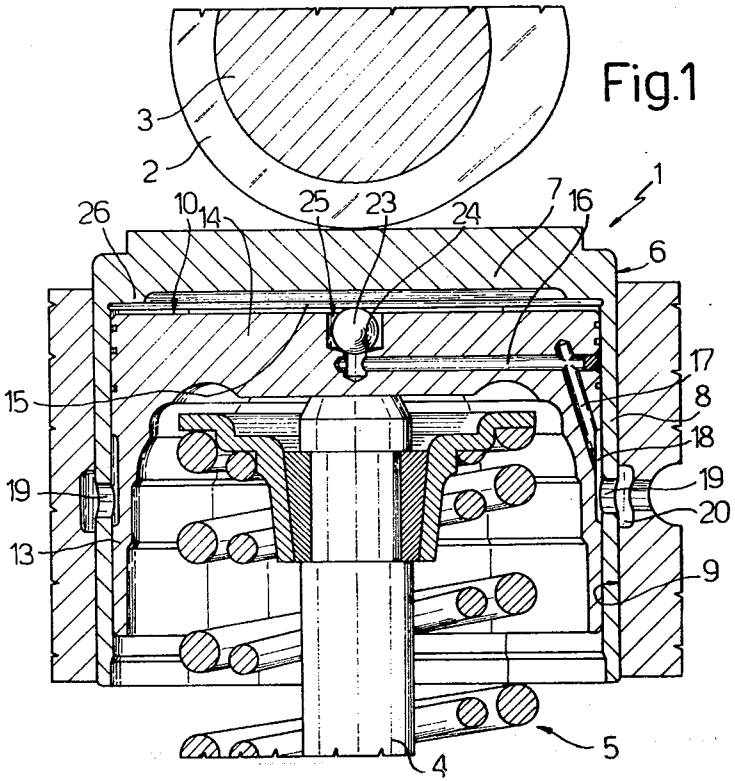
FIG. 1 is a longitudinal section of a first embodiment of the tappet of the invention.

In accordance with the invention the opening of the passage through the duct 16 in the chamber 15 is controlled by a ball 23 which is able to rest on a corresponding, substantially conical seat 24 the axis of which conveniently coincides with that of the end wall 14. In the embodiment of FIG. 1, coaxial with the seat 24 there is formed a cylindrical cavity 25 housing the ball 23, at least partially, with a predetermined radial play.

Conveniently, on the end wall 7 of the first cup-shape body 6 there is formed an annular raised part 26 constituting a shoulder for the end wall 14 of the other body when this is displaced towards the first body; in this way, even when the second cup-shape body 10 is completely within the first, the two end walls 7 and 14 of the two cup-shape bodies are not incontact with one another, leaving the possibility that the ball 23 may become displaced from the seat 24 even in these conditions.

Figure 2:
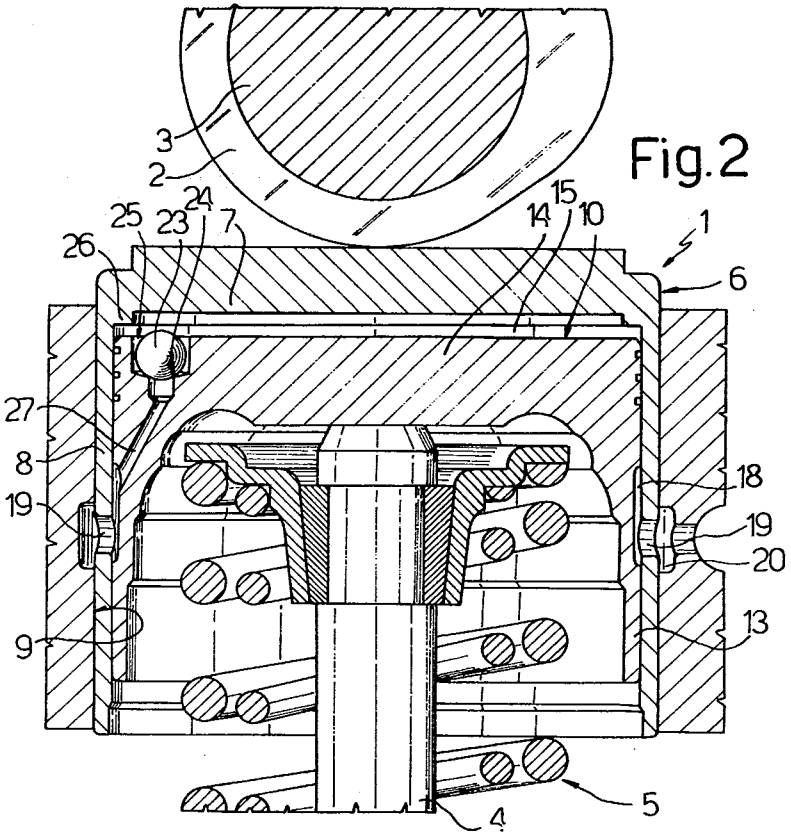
FIG. 2 is a section similar to that of the preceding Figure, of a second embodiment.

In the embodiment of FIG. 2, the seat 24 for the ball 23 is disposed near the periphery of the end wall 14, and is in communication with the first annular cavity 18 by means of a duct 27 formed in the lateral wall 13 of the second cup-shape body. It is evident that there could be provided, in this end wall, a plurality of seats 24 for corresponding balls 23.

Figure 3:
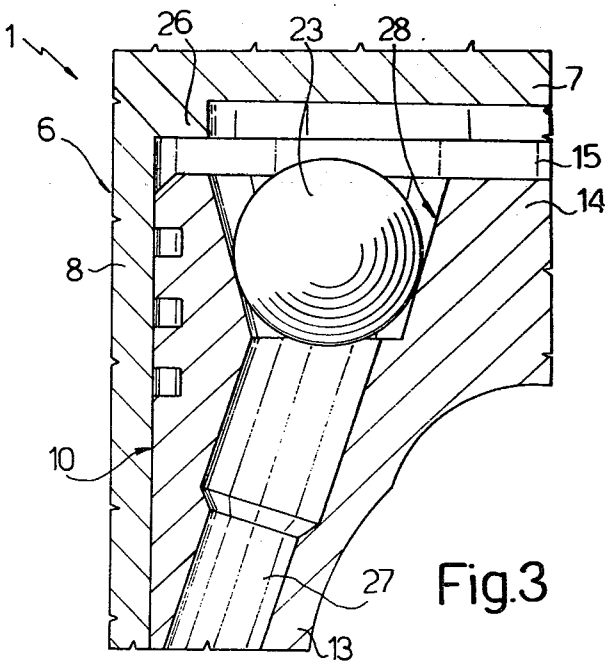

In the detail of FIG. 3 there is illustrated a variant of the seat for the ball 23; in this case such seat substantially comprises a conical surface 28 the generatrices of which form a predetermined angle with respect to the axis of the surface itself; such angle, which conveniently lies between 10° and 20°, must not be too small to avoid the possibility of the ball 23 jamming in the conical surface 28.

In FIG. 4 there is shown a variant of the stop means between the two end walls 7 and 14 of the two cup-shape bodies 6 and 10; in this, rather than providing an annular upstanding part 26 on the end wall 7 of the first cup-shape body 6, there is formed a central upstanding portion 29 on the same end wall 7. Obviously, a similar upstanding part for the same purpose could be formed in the end wall 14 of the other cup-shape body rather than on the end wall 7.

In the embodiment of FIGS. 5 and 6 the forms of the first and second elements 6 and 10 are slightly different from those illustrated with reference to the preceding Figures. In this case the surface 30 of the end wall 7 of the first cup-shape body 6 is flat, and there is formed a central upstanding part 31 on the end wall 14 of the second cup-shape body 10 which is able to abut against the said surface 30 when the second cup-shape body is in its upper end-of-path position. In the embodiment of FIG. 5 there is provided a helical spring 32 (which can, however, be of any other type) which is housed in a corresponding cavity of the wall 14 and which is able to hold the annular upstanding part 31 of the said surface 30 normally spaced from the end wall 7.

Figure 9:
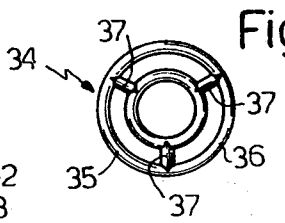

In the two embodiments of FIGS. 5 and 6 the axes of each seat 24 of the associated cylindrical cavity 25 and of the related hole 27 are coincident and inclined at a predetermined angle with respect to the axis of the cup-shape body 10 as can be clearly seen in the Figures themselves. For the purpose of preventing the ball 23 from being able to escape from the associated cavity 25 there are fitted stop means which, in the case of the embodiment of FIG. 5, are constituted by a member 34, illustrated in plan view in FIG. 9, and substantially comprising a pair of coaxial rings 35, 36 connected by spokes 37; the said member, conveniently made from a resiliently deformable material, can be snap inserted in a corresponding annular groove 38 formed in the annular upstanding part 31 of the second cup-shape body 10. The mid-diameter of the ring 36 is chosen in such a way as to coincide substantially with that of the circumference on which the axes of the cavities 25 are located, in such a way that this ring constitutes an axial stop to the movement of the balls 23 in the said cavities.

In the case of the embodiment of FIG. 6, the stop means for the balls 23 are formed by radial pegs 39 inserted in corresponding holes in the upstanding part 31.

The embodiments of FIGS. 5 and 6 may be preferable because they allow large relative displacements of the bodies 6 and 10 without risk of the balls escaping from their seats.

Figure 7:
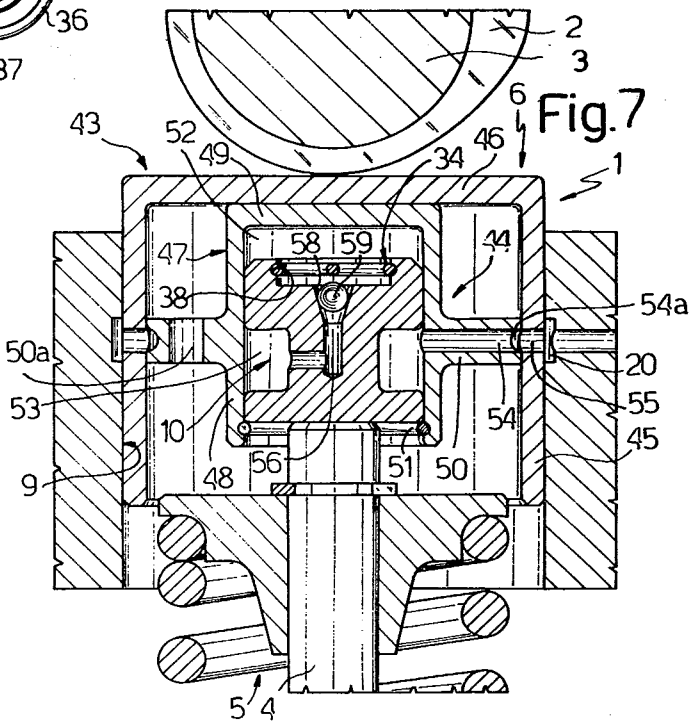
FIGS. 7 and 8 show another two embodiments of the tappet of the invention.
Figure 8:
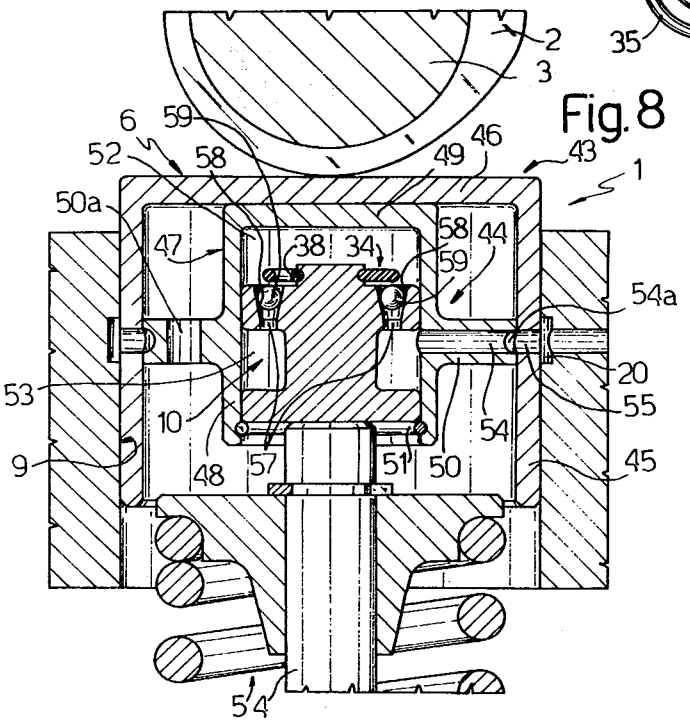

In the embodiment of FIGS. 7 and 8 the first element 6 is constituted by two separate parts, a first part indicated 43 of cup-shape form as was the case for the element 6 of the preceding embodiment, and a second part 44, rigidly connected to the first and inserted in the cavity defined by the side wall 45 and end wall 46 of the other part 43.

The second part 44 substantially comprises a hollow body 47, also provided with a side wall 48 and an end wall 49, as well as an annular projection 50 which can contact the inner surface of the side wall 45 of the first part 43, and which is provided with lightening holes 50*a*.

The second element 10 has a substantially cylindrical form and can slide within the cavity of the hollow body 47 to define with it a chamber 52; conveniently a resilient ring 51 constitutes a stop against downward displacement (as viewed in FIGS. 7 and 8) of the second element 10 with respect to the first 6.

The second element 10 is provided with an annular cavity 53 in communication with the groove 20 through at least one hole 54 and an annular groove 54*a* formed in the annular projection 50, and a hole 55 formed in the side wall 45; the groove 20, in turn, is in communication with a source of liquid under pressure.

The annular cavity 53 is in communication with the chamber 52 by means of holes 56 formed in the central part of the second element 10 as occurs in the case of the embodiment of FIG. 7, or else by means of holes 57 formed in the peripheral part of the same element (FIG. 8). In both these cases, in the region in which each of the holes 56 or 57 opens out into the chamber 52, there is formed a seat 58 for a corresponding ball 59. The shape of each of these seats can be formed in the same way as explained with reference to the preceding embodiments.

In this case also there may be provided stop means for the balls 59, snap-engageable in annular grooves of the element 10 formed on a circular projection of the element itself (FIG. 8) or in a circular recess thereof; the member utilised in this second case can have, in plan, the form illustrated in FIG. 10.

The tappet described above operates in the following way; this is considered first with reference to the first embodiment shown in FIGS. 1, 2, 5 and 6.

When the tappet is in the rest condition there is no liquid in the chamber 15 (or only a small quantity at atmospheric pressure), this having left the chamber itself by seeping through the annular spaces between the facing surfaces of the side walls 8 and 13 of the two cup-shape bodies 6 and 10. As soon as the motor is started oil under pressure arrives at the annular cavity 20 of the engine block and, from this, through the holes 19, the annular cavity 18 and the ducts 16 and 17 (or 27) reaches the seat 24 closed by the ball 23. Since this ball rests only under the action of its own weight on the seat it rises allowing the oil to enter into the chamber 15. The quantity of oil which enters this chamber is that which is necessary to axially space the two cup-shape bodies from one another a distance sufficient to eliminate the clearance between the tappet and the cam 2.

While the valve is opening, because of the force applied to the tappet from the cam 2, the oil pressure within the chamber 15 increases and consequently presses the ball 24 against the associated seat 23, preventing the escape of oil from the chamber; in this phase, therefore, the oil contained in the chamber acts as a hydraulic bearing able to maintain the two cup-shape bodies in their correct relative axial positions.

The operation of the embodiment of the tappet shown in FIGS. 7 and 8 is entirely identical to that described with reference to the preceding embodiment. In this case, the oil from the annular groove 20 arrives in the chamber 52 within the hollow body 47 through the holes 55, the annular groove 54*a*, the hole 54 and the annular cavity 53, and from there traverses the holes 56 (or 57) in such a way as to press the second element 10 against the stem 4 of the valve and the first element 6 against the cam 2.

This second embodiment may be preferable to the first if the tappet is made to be mounted on motors of different types having seats 9 for tappets of different diameters. In fact, the tappets intended for such motors can have identical second elements 10 and first elements 6 with the same structure but a different external diameter; the second parts 44 of such first elements can have the same dimensions with the exception of the outer diameter of the annular projection 50. In this way it will be possible to produce tappets intended for different motors with only the replacement of two of the parts which make up the tappet itself.

It is apparent that the springs, such as the spring 32, interposed between the two elements 6 and 10 can be provided in any of the embodiments described. Similarly, in any of the embodiments, in order to prevent excessive displacement of the balls 23 or 59, such as to make them some completely out of the associated seats, there can be provided stop means of the type illustrated in FIGS. 9 and 10.

It has been found that the tappet of the invention has a better behavior than the prior tappets described, both from the point of view of the elimination of the play between cam and valve during the first operating period of the motor (in which the chamber 15 or 52 is filling with oil), and from the point of view of the discharge of oil from the chamber itself.

In fact, the time required for the filling of this chamber is very small, and much less (equal to about half) than that which is necessary for the filling of the same chamber in the prior art tappets described hereinabove; moreover, a complete filling of this tappet is obtained even if the oil pressure is very low, such as occurs when the engine is running only slowly, and which would not be sufficient to fill the chamber of the prior art tappets discussed above. This favourable behaviour is probably due to the perfect sealing action obtained, in any condition of use, by the interception members devised for the tappet of the invention, and by the small influence exerted by the inertia of such members. It has also been found that this sealing action is improved and much greater than that obtainable with other interception members even in the absence of pressure in the chamber 15 (or 52), a condition which occurs when the engine is stopped; therefore in such conditions the chamber empties only after a long time, due to the seepage which takes place between the lateral sliding surfaces of the two elements 6 and 10, and not at all by loss through the interception members.

It will apparent, then, that the structure of the tappet described hereinabove is very simple being able to dispense completely with resilient members; moreover, the construction of the component parts thereof does not present technological difficulty, the regions of these parts which must be worked with significant precision being of very limited extent; in particular, the most sensitive region from this point of view is constituted by the seat 24 (or 58) for the ball 23 (or 59) and this is of limited extent, is easily accessable, and is of a simple and well defined geometric form.

Because of its very simple structure the operation of the tappet is certain even over long periods of use, therebeing no member which resiliently deforms during the operation and which could therefore give rise to breakages due to fatigue.

It is clear that the various parts of the tappet of the present invention described hereinabove can be modified or varied without by this departing from the scope of the present invention.

I claim:

1. A tappet with an insertable self-adjusting hydraulic assembly, comprising, an open cup-shaped first element having an upper end wall integral with a depending cylindrical side wall to define an internal open area, the first element being slideably positioned within a cylindrical chamber seat formed in a cylinder head of an engine such that the end wall is positioned in line with and adapted to come into contact with a cam axially aligned with and above the cylindrical chamber seat, a smaller second cup-shaped element having an upper end wall and depending side wall which is adapted to be inserted within the first element and symmetrically and rigidly held in position with the end wall thereof in direct engagement with an inner surface of the end wall of the first element, a third cylindrically shaped element mounted within the second element and having its outer periphery in sliding engagement with the inner surface of the depending wall of the second element and in direct alignment with a valve stem disposed within the cylindrical chamber seat and immediately below the third element, and which has a top end surface in contact with a lower end surface of the third element, the third element having a fluid pressure chamber which is connected to a top surface thereof through a fluid supply duct and a valve assembly, the fluid chamber being in direct connection with a fluid supply hole which extends through the side wall of the second element, the fluid supply hole of the second element being aligned with a fluid supply opening in the first element and the latter being connected to a pressurized fluid supply in the cylinder head, the valve assembly of the third element including an enlarged ball accommodating seat at the top end surface of the third element at an upper end of the fluid supply duct at a hole which is of substantially less width than that of the seat, a ball of substantially greater diameter than the hole and substantially less than the upper width of the seat which is disposed substantially wholly within the seat and by its surface engagement with adjacent surfaces blocks the fluid flow through the hole, the seat permitting upward movement of the ball to permit fluid flow, and a readily insertable retainer constituting stop means connected to the top surface of the third element which extends into the seat with its periphery spaced sufficiently from the top surface of the ball member to retain the ball member in the seat and permit its upward movement to allow passage of fluid upwardly through the seat to the space between the top surface of the third element and the upper end wall of the said second cup-shaped element.

2. The tappet as set forth in claim 1, wherein the fluid pressure chamber of the third element is a centrally disposed annular cavity at its outer peripheral central surface.

3. The tappet as set forth in claim 1, wherein the depending side wall of the second element has an outwardly extending annular projection which engages an inner surface of the cylindrical side wall of the first element and which contains a fluid supply duct which is connected between the fluid supply hole of the second element and the fluid supply opening in the first element.

4. The tappet as set forth in claim 1, wherein said seat includes a substantially conical surface into which said duct opens and against the surface of which the ball is lodged to block flow of fluid through the seat.

5. The tappet as set forth in claim 4, wherein additional valve assemblies are provided adjacent the periphery of the top end surface of the third element, and the balls thereof are held in position by the retainer ring which is a single substantially annular resilient retainer, the outer periphery of which extends over a portion of each of the ball accommodating seats.

6. The tappet as set forth in claim 4, wherein the stop means constituting the retainer is a substantially ring-shaped resilient member, the periphery of which is snap-fitted into a corresponding annular groove disposed above the seat and adjacent the top end surface of the third element.

7. The tappet as set forth in claim 6, wherein the enlarged ball accommodating seat is centrally positioned in the third element immediately below a circular recess having the annular groove in which the ring-shaped retainer member is snap-fitted.

* * * * *